US012617603B2

(12) United States Patent
Lee

(10) Patent No.: US 12,617,603 B2
(45) Date of Patent: May 5, 2026

(54) ROTATIONAL DISCHARGE-TYPE COSMETIC CONTAINER

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 127 days.

(21) Appl. No.: 18/702,736

(22) PCT Filed: Oct. 19, 2022

(86) PCT No.: PCT/KR2022/015926
§ 371 (c)(1),
(2) Date: Apr. 18, 2024

(87) PCT Pub. No.: WO2023/085634
PCT Pub. Date: May 19, 2023

(65) Prior Publication Data

US 2024/0409299 A1 Dec. 12, 2024

(30) Foreign Application Priority Data

Nov. 9, 2021 (KR) ..... 10-2021-0153227

(51) Int. Cl.
*B65D 83/00* (2006.01)
*A45D 40/00* (2006.01)
*B65D 47/08* (2006.01)

(52) U.S. Cl.
CPC ..... *B65D 83/7713* (2025.01); *A45D 40/00* (2013.01); *B65D 47/08* (2013.01)

(58) Field of Classification Search
CPC .. B65D 83/7713; B65D 47/08; B65D 83/761; B65D 47/00; B65D 83/765; A45D 40/00;
(Continued)

(56) References Cited

U.S. PATENT DOCUMENTS 12,357,076 B2 * 7/2025 Joung ..... A45D 40/04
2021/0353034 A1 * 11/2021 Lee ..... B05B 11/1001
(Continued)

FOREIGN PATENT DOCUMENTS

KR 20-2013-0001280 U 2/2013
KR 10-1383079 B1 4/2014
(Continued)

*Primary Examiner* — Christopher R Demeree
(74) *Attorney, Agent, or Firm* — Heedong Chae; Lucem, PC

(57) ABSTRACT

A rotational discharge-type cosmetic container according to an embodiment of the present invention comprises: an outer container having a coupling extension portion formed therein; an inner container of which rotation is restricted by being fitted into the coupling extension portion of the outer container and in which content is received; a rotary member rotatably coupled to the outer side of the inner container and having at least one discharge port formed therethrough; a rotary operation member connected to the rotary member to be rotated together and having a first screw thread formed thereon; and a piston screw-coupled to the rotary operation member, fitted into the coupling extension portion of the outer container to be movable in a straight line, formed in the inner container and an elevating member having a second screw thread formed on.

14 Claims, 7 Drawing Sheets

(58) Field of Classification Search
CPC .... A45D 40/0075; A45D 40/04; A45D 40/26; A45D 34/04; A45D 2200/055; A45D 34/00; A45D 40/06; A45D 2040/0006; A45D 40/14
USPC ..... 222/95, 144, 167, 302; 401/68; 132/312
See application file for complete search history.

(56) References Cited

U.S. PATENT DOCUMENTS

| | | | | |
|---|---|---|---|---|
| 2023/0107286 | A1* | 4/2023 | Lee | A45D 40/14 401/78 |
| 2023/0180916 | A1* | 6/2023 | Byeon | A45D 40/06 401/108 |

FOREIGN PATENT DOCUMENTS

| | | | |
|---|---|---|---|
| KR | 20-0476045 | Y1 | 1/2015 |
| KR | 20-2019-0002197 | U | 8/2019 |
| KR | 10-2279516 | B1 | 7/2021 |

* cited by examiner

ROTATIONAL DISCHARGE-TYPE COSMETIC CONTAINER

TECHNICAL FIELD

The present invention relates to a cosmetic container and, more specifically, to a rotational discharge-type cosmetic container for converting the rotation operation of the rotary member into straight motion of the elevating member through the rotary operation member to move the piston within the inner container, so that the contents stored in the inner container is smoothly discharged to the outside without leakage.

BACKGROUND ART

Recently, in the rapidly diversifying modern society, both men and women of all ages use cosmetics as necessary. In particular, women use various types of cosmetics and tools with various colors, and various high-quality cosmetics and tools are released on the market day by day through research and development by cosmetics-related companies.

Depending on the purpose of use, the cosmetics are classified into facial cleansing cosmetics used to remove sebum, waste, and pollutants on the skin surface; basic cosmetics used to appropriately supply moisture and oil to the skin; color cosmetics used to express beautiful colors; hair cosmetics used to remove foreign substances of hair or scalp and simultaneously protect the hair and provide nourishment; and perfume obtained by dissolving fragrance in alcohol or the like and used to give fragrance to others.

As the above cosmetics are developed, it is also necessary to develop various cosmetic containers capable of containing the cosmetics.

In general, in order to store and use cosmetics having a liquid or gel form, such as lotion, cream, gel, shampoo and or rinse, containers simply having an opening and closing function have been used in the related art, and accordingly the cosmetics are taken out from the container and applied to the skin by using a finger or a cosmetic tool such as a puff.

However, according to the cosmetic container in the related art, the cosmetics may be completely exposed to the air and oxidized since the cosmetic container in related art is required to be used while a lid of the container is opened, and the cosmetics may be contaminated by bacteria, viruses, molds, and the like since the puff having contacted with the skin is repeatedly contacted with the cosmetics during use, thereby causing skin troubles or shortening the use period. In addition, in the cosmetic container in the related art, since cosmetics are used by dispensing the cosmetics using a finger or a cosmetic tool such as a puff, the used amount of cosmetics fails to be controlled consistently, thereby resulting in waste and inconvenience in use of the cosmetics.

Accordingly, a rotational discharge-type cosmetic container, which minimizes deterioration and contamination during using cosmetics, and allows convenience in use and uniformly control the used amount of cosmetics, has been developed.

As a related art having the above structure, Korean Registered Patent No. 10-2188196 (hereinafter, referred to as "related art") discloses a cosmetic container. The above related art includes: an inner case having an inner space; a rotary bezel rotatably coupled to an upper portion of the inner case and having a discharge hole; a rotary member positioned in the inner space and coupled to the rotary bezel so as to be integrally rotated with the rotary bezel; a piston positioned in the inner space and coupled to the rotary member to ascend or descend in conjunction with the rotation of the rotary member, wherein the contents are discharged through the discharge hole by the ascent of the piston. Accordingly, the contents may be conveniently discharged and hygienically used.

However, the related art has a structure in which the rotary member is screw-coupled to the center of the piston and an edge of the piston comes into close contact with an inner wall of the inner case. When the piston does not completely come into close contact with the inner case, the piston may be rotated together with the rotary member at the time of the rotation operation of the rotary bevel and fail to ascend and descend with respect to the rotary member as an axis, thereby causing an operation failure.

In order to solve the above problems, Korean Registered Patent No. 10-2213437 (hereinafter, referred to as "related art") discloses a cosmetic container having a screw-driven discharge structure.

The above related art includes: a cosmetic storage container having an accommodation space for accommodating cosmetics; a lower case portion installed therein with the cosmetic storage container; an upper case portion fastened to the lower case portion so as to be opened and closed; a cosmetic discharge portion formed on an upper part of the cosmetic storage container to serve to discharge the cosmetics; and a cosmetic transfer means for transferring the cosmetics toward the cosmetic discharge portion, wherein the cosmetic transfer means includes: a rotational force applying portion rotated by an external force and provided with a screw connection portion; a driving screw connected to the screw connection portion of the rotational force applying portion so as to be rotated and having a screw thread formed on an outer circumferential surface thereof in a spiral shape; and an elevating member built in the cosmetic storage container and screw-coupled to the driving screw to move and discharge the cosmetics while ascending and descending.

However, according to the related art, the elevating member for pushing up the cosmetics and the driving screw for moving the elevating member are positioned in the inner space of the cosmetic storage container and screw-coupled to each other, an elevating guide shaft and an elevating guide hole are formed in the cosmetic storage container and the elevating member, respectively, and are fitted with each other in order to limit the rotation of the elevating member. Thus, the cosmetics may be leaked out and wasted through a gap between the elevating member and the driving screw or between the elevating guide shaft and the elevating guide hole.

RELATED ART DOCUMENT

Patent Document (Patent document 001) Korean Registered Patent No. 10-2188196 (Published on Dec. 9, 2020)

(Patent document 002) Korean Registered Patent No. 10-2213437 (Published on Feb. 5, 2021).

DISCLOSURE

Technical Problem

In order to solve the above problems in the related art, an object of one aspect of the present disclosure is to provide a rotational discharge-type cosmetic container for connecting the rotary member to the elevating member through the rotary operation member and converting the rotation operation of the rotary member into straight motion of the elevating member through the rotary operation member to move the piston within a predetermined section in the inner container, so that the contents stored in the inner container is smoothly discharged to the outside without leakage.

Technical Solution

In order to solve the above object, the one aspect of the present disclosure provides a rotational discharge-type cosmetic container including: an outer container having a coupling extension portion formed therein; an inner container fitted into the coupling extension portion of the outer container so as to be restricted in rotation to accommodate contents therein; a rotary member rotatably coupled to an outer side of the inner container and having at least one discharge port formed therethrough; a rotary operation member connected to the rotary member to be rotated together and having a first screw thread formed thereon; an elevating member screw-coupled to the rotary operation member, inserted into the coupling extension portion of the outer container so as to be straight movable, and having a second screw thread formed thereon; and a piston formed inside the inner container and coupled to one side of the elevating member to push and discharge the contents toward the discharge port while being straight moved together with the elevating member.

In addition, the outer container has one open side to which a shoulder is further coupled.

In addition, a container cover for opening or closing the rotary member is further included.

In addition, the coupling extension portion has a tube shape extending upward from a center of a bottom of the outer container.

In addition, the coupling extension portion of the outer container is formed on an inner circumference thereof with a rotation limiting protrusion, and the inner container is formed on an outer circumference thereof with a rotation limiting groove, so that the rotation limiting protrusion and the rotation limiting groove are coupled to each other, thereby limiting the rotation of the inner container.

In addition, the coupling extension portion of the outer container is formed on an outer circumference thereof with a straight guide protrusion, and the elevating member is formed on an inner circumference thereof with a straight guide groove, so that the straight guide protrusion and the straight guide groove are coupled to each other, thereby guiding the straight movement of the elevating member.

In addition, the coupling extension portion of the outer container is formed at a center thereof with an insertion hole into which at least a part of the inner container is inserted, and the insertion hole and the inner container are formed therein with a first locking protrusion and a second locking protrusion, respectively, so as to be locked and coupled to each other.

In addition, the rotary member has at least a part exposed from the outer container, and is rotatably coupled to the inner container while surrounding an upper part of the inner container.

In addition, the discharge port is formed on a top surface of the rotary member and includes a straight hole extending from a center to an edge part of the rotary member.

In addition, the rotary member is formed therein with a discharge guide protrusion adjacent to the discharge port, and the discharge guide protrusion protrudes inward from the rotary member.

In addition, the rotary operation member includes an inner wall extending upward from a bottom, a first outer wall spaced apart from the inner wall by a predetermined distance and extending upward, and a second outer wall spaced apart from the first outer wall by a predetermined distance and extending upward.

In addition, an end of the rotary member is inserted between the first outer wall and the second outer wall of the rotary operation member, and a plurality of first insertion protrusions and second insertion protrusions are formed on the rotary member and the first outer wall, respectively, so as to be inserted and coupled to each other.

In addition, the elevating member has a side wall divided into at least two parts, and the inner container is formed on a bottom surface thereof with a through-hole, in which the divided side wall passes through the through-hole so as to be inserted into an inner space of the inner container.

Advantageous Effects

According to the embodiments of the one aspect of the present disclosure, since the sealing between the inner container for storing the contents therein and the piston ascending and descending within the inner container is stably maintained even during operation, all of the contents is used without leakage, so that resources can be prevented from being wasted and the contents can be hygienically used.

According to the embodiments of the one aspect of the present disclosure, the rotary member operated by a user and the elevating member for moving the piston in a predetermined section are tightly interworked with each other through the rotary operation member, so that a fixed quantity of contents stored in the inner container can be smoothly discharged to the outside without operational errors during use.

BEST MODE

Mode for Invention

Figure 1:
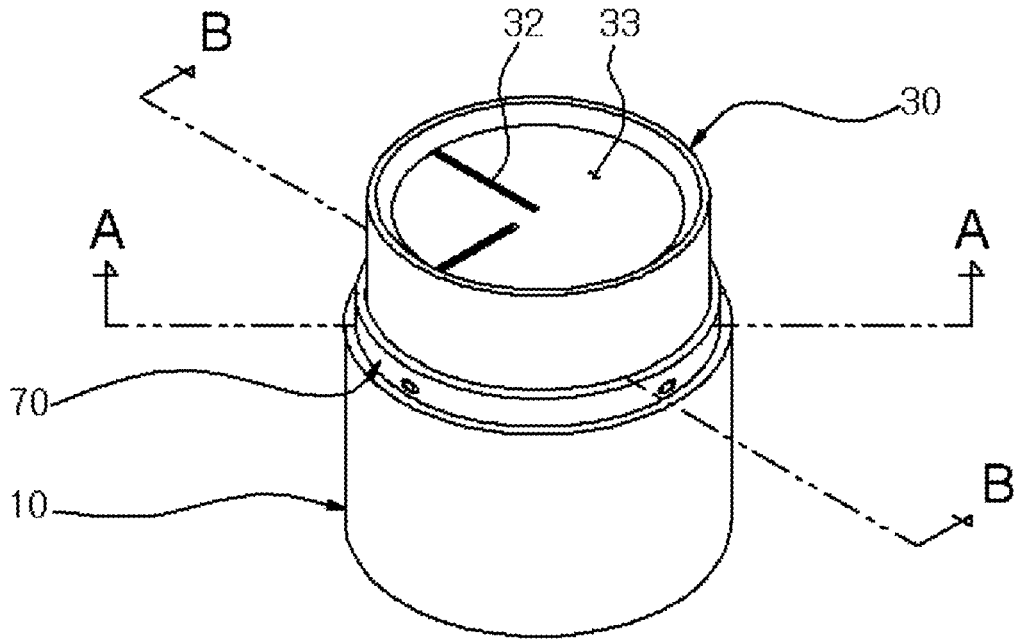
FIG. 1 is a perspective view of a cosmetic container according to the embodiment of the one aspect of the present disclosure.

Hereinafter, the embodiments for implementing the one aspect of the present disclosure will be described detailed description of the one aspect of the present disclosure and the corresponding embodiments refer to the accompanying drawings as examples. These embodiments will be described in detail to enable a person having ordinary skill in the art to sufficiently implement the one aspect of the present disclosure. It will be understood that various embodiments of the one aspect of the present disclosure are different from each other, but need not be exclusive mutually. For example, the specific shapes, structures, and features described herein may be embodied as other embodiments without departing from the idea and scope of the present disclosure in relation to one embodiment. In addition, it will be understood that the position or arrangement of individual components in each disclosed embodiment may be modified without departing from the idea and scope of the present disclosure.

Accordingly, the detailed description described later is not intended to be taken in a limiting meaning, and the scope of the present disclosure is limited only by the appended claims in addition to all the scope equivalent to that claimed by the claims if appropriately described. In the drawings, similar reference numerals refer to the same or similar functions over several aspects.

The terms used in the one aspect of the present disclosure are selected as general terms currently widely used as possible while considering functions in the one aspect of the present disclosure, but may vary depending on, for example, the intention or precedent of a person having ordinary skill in the art, and the emergence of new technologies. In addition, in specific cases where the terms may be arbitrarily selected by the applicant, the meaning thereof will be described in detail in the corresponding description of the present disclosure. Therefore, the terms used in the present disclosure will be defined based on the meanings of the terms and the context throughout the present disclosure, other than simple names of the terms.

In the one aspect of the present disclosure, when a certain part "includes" a certain component, it signifies that other components may be further included, rather than excluding the other components, unless otherwise stated.

Hereinafter, a rotational discharge-type cosmetic container according to the embodiments of the present disclosure will be described in detail with reference to the accompanying drawings.

Figure 2:
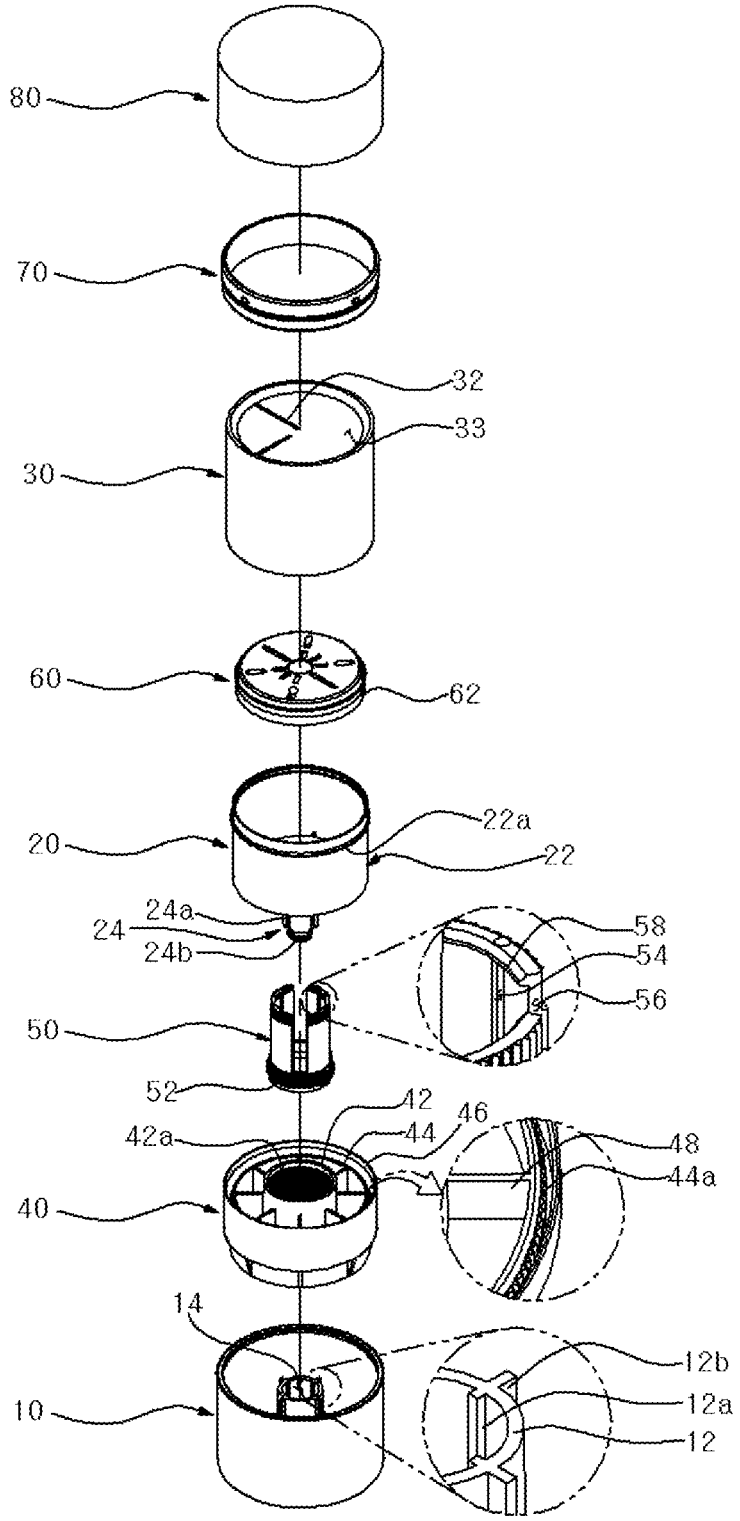
FIG. 2 is an exploded perspective view when viewed from the upper side of the cosmetic container according to the embodiment of the one aspect of the present disclosure.
Figure 3:
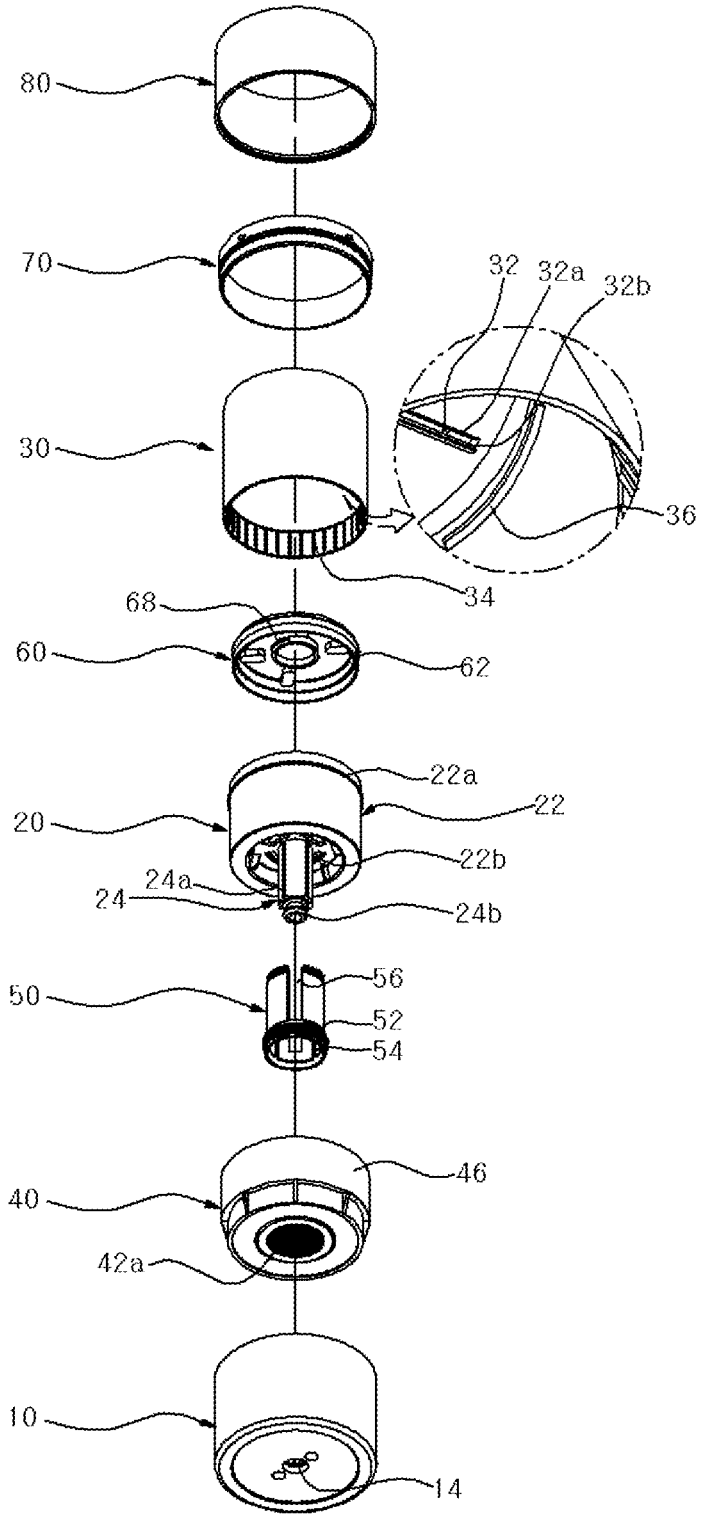
FIG. 3 is an exploded perspective view when viewed from the lower side of the cosmetic container according to the embodiment of the one aspect of the present disclosure.
Figure 4:
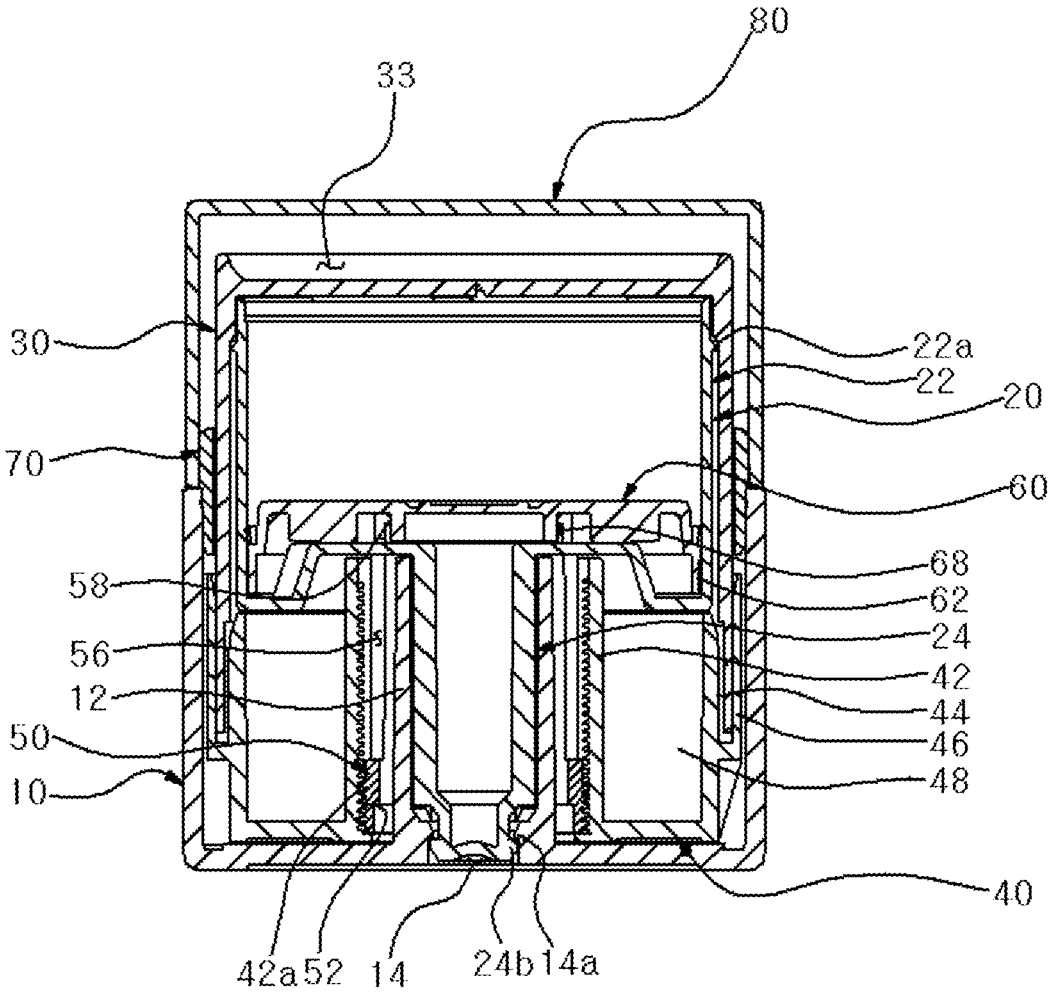
FIG. 4 is a sectional view taken along line A-A of FIG. 1.
Figure 5:
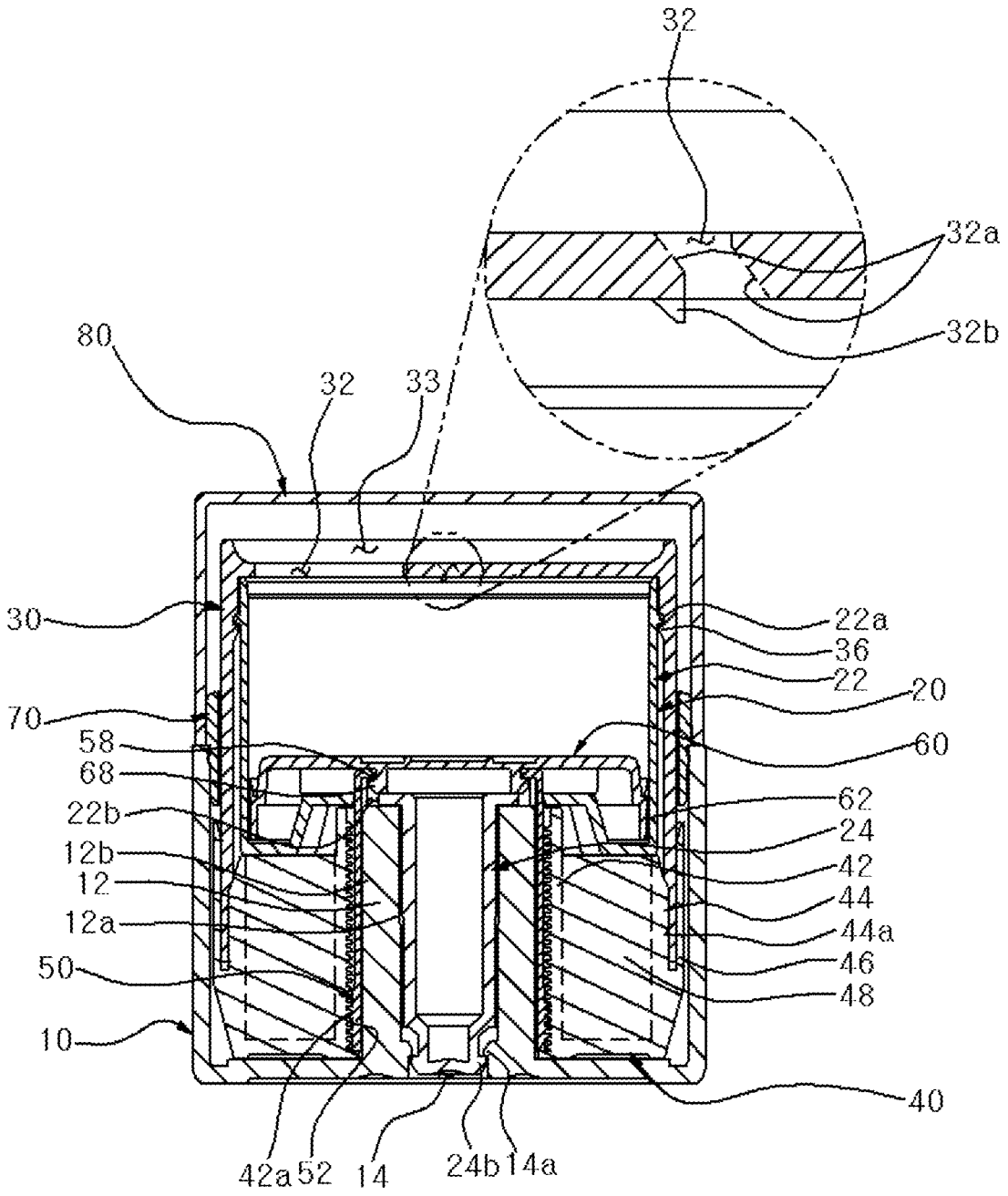
FIG. 5 is a sectional view taken along line B-B of FIG. 1.

FIG. 1 is a perspective view of a cosmetic container according to the embodiment of the present disclosure; FIG. 2 is an exploded perspective view when viewed from the upper side of the cosmetic container according to the embodiment of the present disclosure; FIG. 3 is an exploded perspective view when viewed from the lower side of the cosmetic container according to the embodiment of the present disclosure; FIG. 4 is a sectional view taken along line A-A of FIG. 1; and FIG. 5 is a sectional view taken along line B-B of FIG. 2.

As shown in the drawings, the rotational discharge-type cosmetic container according to the embodiment of the present disclosure may include an outer container 10, an inner container 20, a rotary member 30, a rotary operation member 40, an elevating member 50, and a piston 60.

Each component of the rotational discharge-type cosmetic container according to the embodiment of the present disclosure will be described as follows.

The outer container 10 has a cylindrical shape with one side open and has a predetermined inner space, and the remaining components, that is, the inner container 20, the rotary member 30, the rotary operation member 40, the elevating member 50 and the piston 60 are inserted into and coupled to the inner space.

As shown in FIG. 2, a coupling extension portion 12 may be formed at a center of the inside of the outer container 10. The coupling extension portion 12 has a tube shape (which collectively refers to an object having a round and hollow body) extending upward from a top surface of a bottom of the outer container 10, in which an insertion hole 14 is formed at a center thereof, so that at least a part of the inner container 20 is inserted into the insertion hole 14 and the elevating member 50 covers an upper outer side thereof. A first locking protrusion 14*a* locked and coupled to the inner container 20 may protrude from a side wall of the insertion hole 14. In addition, a rotation limiting protrusion 12*a* for limiting rotation of the inner container 20 may be formed on an inner circumference of the coupling extension portion 12, and a straight guide protrusion 12*b* for guiding straight movements of the elevating member 50 may be formed on an outer circumference thereof. It is preferable that the rotation limiting protrusion 12*a* extends long in a longitudinal direction of the inner container 20, the straight guide protrusion 12*b* extends long in a moving direction of the elevating member 50, and a plurality of rotation limiting protrusions 12*a* and straight guide protrusions 12*b* are formed on the inner circumference and the outer circumference of the coupling extension portion 12, respectively, to stably operate interrelated components.

Meanwhile, a shoulder 70 may be further coupled to one open side of the outer container 10. The shoulder 70 may be formed in a ring shape having a predetermined height to have at least a part inserted into the outer container 10 and a remaining part exposed upward from the outer container 10. As shown in FIGS. 4 and 5, the shoulder 70 blocks a gap between the outer container 10 and the rotary member 30 to prevent foreign substances from being introduced and simultaneously prevent the rotary operation member 40 coupled to the inside of the outer container 10 from being separated. The drawing of the cosmetic container according to the embodiment of the present disclosure illustrates that the groove is formed on the inner circumference of the outer container 10 and the protrusion is formed on the outer circumference of the shoulder 70 so as to be coupled to each other, but the present disclosure is not limited thereto. Various types of coupling structures such as undercut coupling, forced fitting coupling, and screw coupling may be provided within a range in which the shoulder 70 may be stably fixed and coupled to the outer container 10.

In addition, a container cover 80 for opening or closing the rotary member 30 may be formed on one side of the outer container 10. The container cover 80 is detachably fastened to the shoulder 70 while covering the rotary member 30, separated from the shoulder 70 in use to expose the rotary member 30 to the outside, and coupled to the shoulder 70 to protect the rotary member 30 when being stored or carried. The container cover 80 may be detachably fastened to the outer container 10 other than the shoulder 70.

The inner container 20 refers to a storage body in which liquid or gel-type contents are stored, and is inserted and coupled to the inner space of the outer container 10. At least a part of the inner container 20 is inserted and coupled to the coupling extension portion 12 1 of the outer container 10, restricted in rotation, and fixed inside the outer container 10.

As shown in FIGS. 2 and 3, the inner container 20 may include a storage portion 22 and a coupling portion 24 extending from a center of a bottom of the storage portion 22.

The storage portion 22 is provided with a predetermined storage space for accommodating contents therein and has one open side, in which the piston 60 is positioned therein. The storage portion 22 may be formed on an outer circumference thereof with a first fastening protrusion 22*a* so as to be rotatably coupled to the rotary member 30, and may be formed on a bottom surface thereof with at least two through-holes 22*b* through which the elevating member 50 passes.

The coupling portion 24 is inserted and coupled to the center of the coupling extension portion 12 of the outer container 10. In other words, the coupling portion 24 is formed on the outer circumference thereof with a rotation limiting groove 24*a* so as to be fitted into the rotation limiting protrusion 12*a* of the coupling extension portion 12, and is formed with a second locking protrusion 24*b* adjacent to the rotation limiting groove 24*a* so as to be locked and coupled to the first locking protrusion 14*a* of the coupling extension portion 12. Therefore, when the rotary member 30 is rotated, the inner container 20 may be fixed without being rotated together, and the inner container 20 may be prevented from being separated and deviated from the outer container 10.

The rotary member 30 is rotatably coupled to an outer side of the inner container 20 and rotatably manipulated by the user to transmit rotational motion to the rotary operation member 40. In other words, as shown in FIGS. 4 and 5, at least a part of the rotary member 30 may be inserted into the outer container 10 and coupled to the rotary operation member 40, and the remaining part thereof may be exposed to the outside of the outer container 10 and rotatably coupled to the inner container 20 while surrounding an upper part of the inner container 20.

The rotary member 30 has a cylindrical shape with one open side to which the inner container 20 may be inserted, and has an end inserted into the rotary operation member 40.

As shown in FIG. 2, a discharge port 32 for discharging the contents stored in the inner container 20 to the outside may be formed in a top surface of the rotary member 30, that is, in an opposite side of the one open side. It is preferable that at least one more discharge ports 32 are provided and include a straight hole elongated from a center of the rotary member 30 toward an edge part. The discharge ports 32 are radially spaced apart from each other at a predetermined angle on the top surface of the rotary member 30, and a discharge area or position of the contents may be variously adjusted according to the number of discharge ports 32, the angle spaced apart from the adjacent discharge port 32, and the like. For example, the discharge ports 32 may be intensively arranged in a part of the top of the rotary member 30, so that the contents are discharged while being limited to a partial area of the top surface of the rotary member 30. On the contrary, the discharge ports 32 may be uniformly arranged over the entire top surface of the rotary member 30, so that the contents are discharged while being widely spread over the entire area of the top surface of the rotary member 30. The drawing of the cosmetic container according to the embodiment of the present disclosure illustrates that the two discharge ports 32 are formed and spaced apart from each other at an angle of 90 degrees, but the present disclosure is not limited thereto, and the number of discharge ports 32 and the spaced angle may be modified according to the discharge area and the discharge amount of the contents.

A discharge space 33 may be formed in the top surface of the rotary member 30, and it is preferable that the discharge space 33 may be formed to be recessed inward from an upper part of the rotary member 30 to prevent the contents discharged from the inner container 20 from flowing outward.

As shown in FIG. 3, a plurality of first insertion protrusions 34 may be formed on an inner circumference of an end of the rotary member 30, and it is preferable that the first insertion protrusions 34 may be spaced apart from each other at a predetermined interval along the inner circumference of the rotary member 30 and extend vertically along an insertion direction of the rotary member 30.

A second fastening protrusion 36 may be formed inward on the inner circumference of the rotary member 30 so as to be rotatably undercut-coupled to the first fastening protrusion 22*a*. It is preferable that the second fastening protrusion 36 protrudes at a predetermined section along the inner circumference of the rotary member 30.

Meanwhile, as shown in a partially enlarged view of FIG. 5, discharge guide oblique surfaces 32*a* and a discharge guide protrusion 32*b* may be formed adjacent to the discharge port 32. The discharge guide oblique surfaces 32*a* may be inclined at a predetermined angle on both side walls of the discharge port 32, and the discharge guide protrusion 32*b* may protrude from any one of the discharge guide oblique surfaces 32*a* toward the inside of the rotary member 30, thereby controlling a direction of the contents discharged with respect to the discharge port 32 having the straight shape. In other words, when the rotary member 30 is rotated, the piston 60 is moved by a predetermined section to push the contents upward, and the discharge guide protrusion 32*b* is simultaneously rotated to sweep an upper surface of the contents upward, so that the contents are more smoothly discharged to the outside through the discharge port 32, and the contents may be discharged in any one direction around the discharge port 32 while being moved and guided by the discharge guide oblique surface 32*a* inclined at the predetermined angle.

The rotary operation member 40 is inserted into the outer container 10 and connected to the rotary member 30 so as to be rotated and operated together. The rotary operation member 40 connects the rotary member 30 to the elevating member 50 to convert the rotational manipulation of the rotary member 30 into the straight movement of the elevating member 50.

As shown in FIG. 2, The rotary operation member 40 may include an inner wall 42 extending upward from a bottom, a first outer wall 44 spaced apart from the inner wall 42 by a predetermined distance and extending upward, and a second outer wall 46 spaced apart from the first outer wall 44 by a predetermined distance and extending upward.

The inner wall 42 is a hollow cylinder formed inside the rotary operation member 40, has a center into which the coupling extension portion 12 of the outer container 10 and the elevating member 50 are inserted, and has a first screw thread 42*a* formed on the inner circumference thereof so as to be screw-coupled to the elevating member 50.

The first outer wall 44 is a cylinder extending to the outside of the inner wall 42, and has a plurality of second insertion protrusions 44*a* formed on the outer circumference thereof so as to be fitted and coupled to the first insertion protrusion 34 of the rotary member 30. It is preferable that the second insertion protrusions 44*a* are spaced apart from each other by a predetermined interval along the outer circumference of the first outer wall 44, and extend vertically along the insertion direction of the rotary member 30 like the first insertion protrusion 34.

The second outer wall 46 is a cylinder expanding to the outside of the first outer wall 44, and the end of the rotary member 30 may be inserted between the first outer wall 44 and the second outer wall 46. Accordingly, the rotary member 30 is inserted between the first outer wall 44 and the second outer wall 46 of the rotary operation member 40 and stably fixed and coupled to each other, so that the rotary operation member 40 may be smoothly operated.

Meanwhile, a plurality of reinforcing ribs 48 may be formed between the inner wall 42 and the first outer wall 46 of the rotary operation member 40 to connect the inner wall 42 to the first outer wall 44. The reinforcing ribs 48 radially extend from the outer circumference of the inner wall 42 to the inner circumference of the first outer wall 46, and the number of reinforcing ribs may be appropriately adjusted in consideration of durability and productivity of the rotary operation member 40.

The elevating member 50 is inserted into the coupling extension portion 12 of the outer container 10 so as to be straight movable, and is screw-coupled to the rotary operation member 40. In other words, the elevating member 50 is configured to be interworked with the rotation operation of the rotary operation member 40 to ascend or descend in a driving manner by screw fastening, and inserted into the center of the inner wall 42 of the rotary operation member 40 while covering the outer side of the coupling extension portion 12 of the outer container 10.

A second screw thread 52 is formed on the outer circumference of the elevating member 50 and screw-coupled to the first screw thread 42*a* of the rotary operation member 40, and accordingly, the elevating member 50 is moved upward or downward about the rotating rotary operation member 40 as an axis. A straight guide groove 54 is formed on the inner circumference of the elevating member 50 and fitted to the straight guide protrusion 12*b* of the outer container 10, and accordingly, the elevating member 50 is straight moved about the coupling extension portion 12 of the outer container 10 as n axis without being rotated together with the rotary operation member 40. It is preferable that the straight guide groove 54 extend straight and long along the moving direction of the elevating member 50 like the straight guide protrusion 12*b* of the outer container 10.

Meanwhile, the side wall of the elevating member 50 may be divided into at least two parts and inserted into the through-holes 22*b* of the inner container 20, respectively. In other words, a slit 56 is formed on the side wall of the elevating member 50 to divide the side wall, and the divided side wall passes through the through-hole 22*b* so as to be inserted into the inner space of the inner container 20. This is for positioning at least a part of the elevating member 50 into the inner container 20 so as to be connected to the piston 60. A first coupling protrusion 58 may protrude inward from the inner circumference of the end of the elevating member 50 inserted into the inner space of the inner container 20 so as to be coupled to the piston 60. It is preferable that the divided side walls of the elevating member 50 are formed to have a width, a number, and a position corresponding to the through-holes 22*b* of the inner container 20.

The piston 60 is formed in the inner container 20 to discharge the contents accommodated in the inner container 20 while being straight moved together with the elevating member 50.

The piston 60 pushes the contents stored in the inner container 20 in a direction of the discharge port 32 of the rotary member 30 while coming into close contact with the inner circumference of the inner container 20 and discharges the contents to the outside, in which a piston blade 62 coming into close contact with the inner circumference of the inner container 20 may be formed at the edge of the piston 60.

Meanwhile, a second coupling protrusion 68 may be formed on a lower surface of the piston 60, that is, on an opposite side of the surface pushing the contents, so as to be fixedly coupled to the first coupling protrusion 58 of the elevating member 50.

As described above, the one aspect of the present disclosure is operated in the driving manner by screw fastening, in which the rotary member 30 is connected to the elevating member 50 through the rotary operation member 40, and the rotation operation of the rotary member 30 is converted into the straight motion of the elevating member 50 through the rotary operation member 40 to move the piston 60 within the inner container by a predetermined section, thereby using all the contents without leakage, so that the resources can be prevented from being wasted, the contents can be hygienically used, and the contents stored in the inner container 20 can be smoothly discharged to the outside without operational defects during use.

Figure 6:
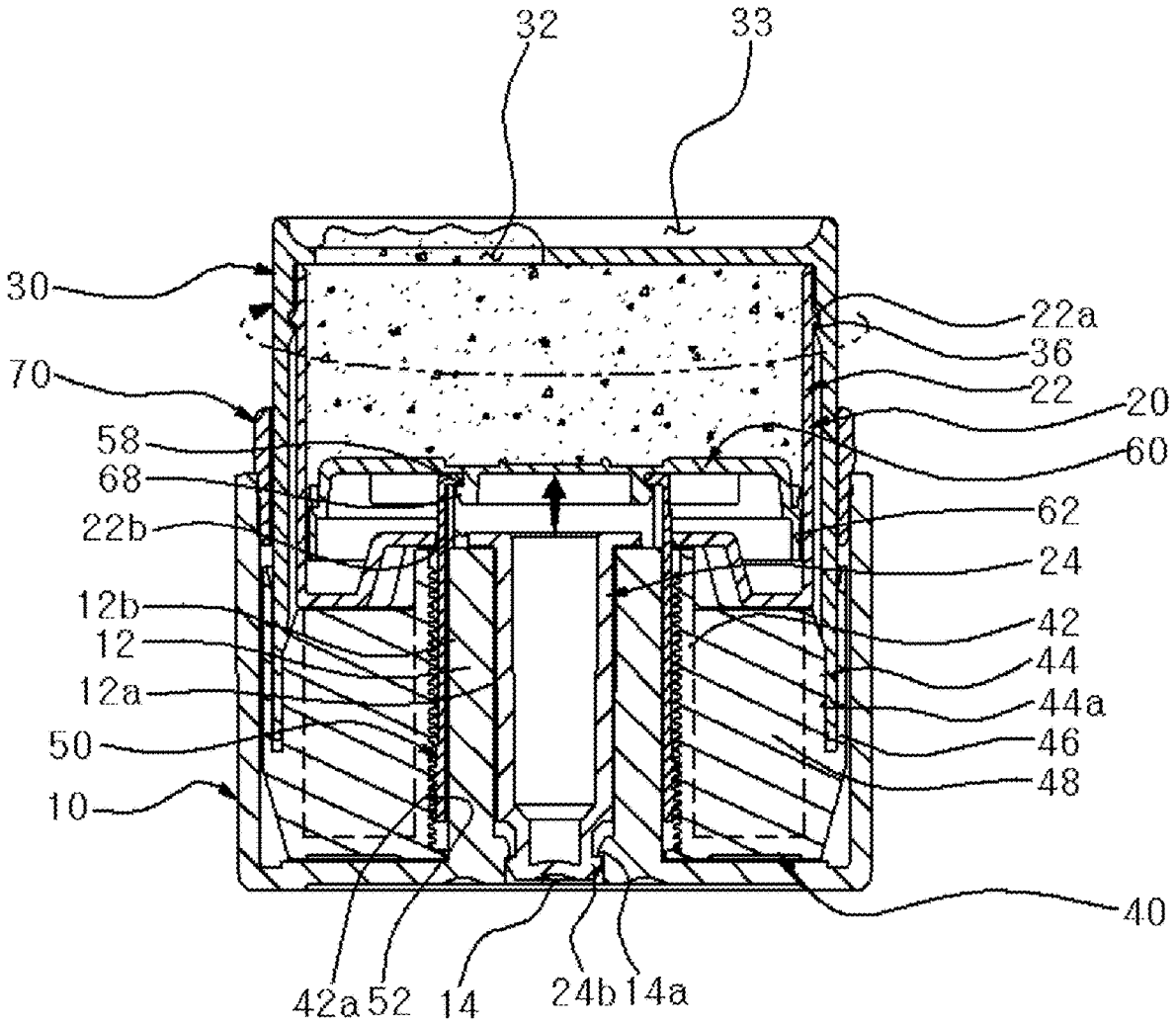
FIG. 6 is a sectional view illustrating a state in which contents are discharged according to the embodiment of the one aspect of the present disclosure.
Figure 7:
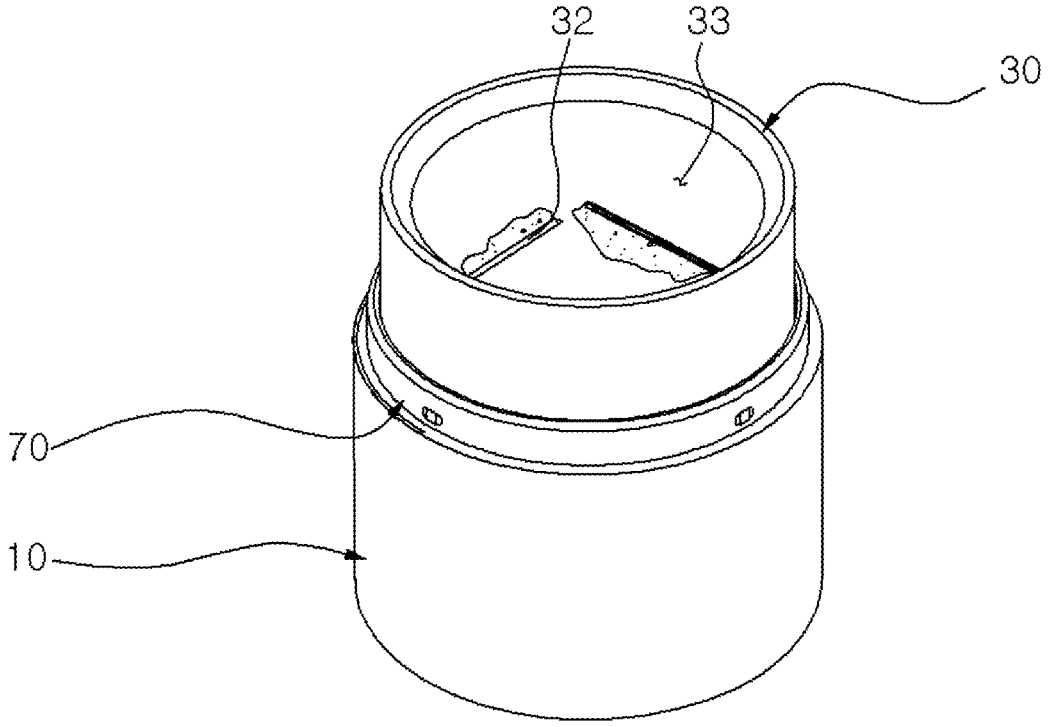
FIG. 7 is a perspective view illustrating a state in which contents are discharged according to the embodiment of the one aspect of the present disclosure.

FIGS. 6 and 7 are views showing an operation process of the rotational discharge-type cosmetic container according to the embodiment of the present disclosure. A process of using the rotational discharge-type cosmetic container according to the embodiment of the present disclosure will be described with reference to the drawings.

FIG. 6 is a sectional view illustrating a state in which contents are discharged according to the embodiment of the present disclosure; and FIG. 7 is a perspective view illustrating a state in which the contents are discharged according to the embodiment of the present disclosure.

In order to use the rotational discharge-type cosmetic container according to the embodiment of the present disclosure, first, the container cover 80 is separated from the outer container 10 to expose the rotary member 30 to the outside.

Thereafter, as shown in FIG. 6, when the rotary member 30 is rotated in any one direction, the rotary operation member 40 connected to the rotary member 30 is rotated together. However, the rotation of the inner container 20 and the elevating member 50 is limited by the outer container 10 held by the user, and thus the elevating member 50 screw-coupled to the rotary operation member 40 is gradually moved upward in proportion to the rotation section of the rotary operation member 40.

At the same time, the piston 60 coupled to one side of the elevating member 50 pushes the contents toward the discharge port 32 while being moved upward within the inner container 20, and accordingly, as shown in FIG. 7, a predetermined amount of the contents is discharged to the outside through the discharge port 32.

Thereafter, the contents discharged to the discharge space 34 of the rotary member 30 are put on a makeup tool such as a puff (not shown) and uniformly applied onto the skin for makeup.

After the makeup is finished, the rotary member 30 is coupled to the shoulder 70 while being covered by the container cover 80, so as to be stored or carried.

As described above, the one aspect of the present disclosure has been described through the specific features, such as specific components, the limited embodiments and the drawings, but these are provided only for further general understanding of the present disclosure, and the one aspect of the present disclosure is not limited to the above embodiments, and various modifications and variations may be made by the person having ordinary skill in the art from the above description. Therefore, the idea of the present disclosure may not be limited to the described embodiments, and the claims described below and anything equal or equivalent to the claims may belong to the scope of the idea of the present disclosure.

[Description of Reference Numerals]

| | |
|---|---|
| 10: Outer container | 12: Coupling extension portion |
| 20: Inner container | 22: Storage portion |
| 24: Coupling portion | 30: Rotary member |
| 32: Discharge port | 40: Rotary operation member |
| 42: Inner wall | 42a: First screw thread |
| 44: First outer wall | 46: Second outer wall |
| 50: Elevating member | 52: Second screw thread |
| 60: Piston | 70: Shoulder |
| 80: Container cover | |

The invention claimed is:

1. A rotational discharge-type cosmetic container comprising:

an outer container having a coupling extension portion formed therein;

an inner container fitted into the coupling extension portion of the outer container so as to be restricted in rotation to accommodate contents therein;

a rotary member rotatably coupled to an outer side of the inner container and having at least one discharge port formed therethrough;

a rotary operation member connected to the rotary member to be rotated together and having a first screw thread formed thereon;

an elevating member screw-coupled to the rotary operation member, inserted into the coupling extension portion of the outer container so as to be movable in a straight line, and having a second screw thread formed thereon; and a piston formed inside the inner container and coupled to one side of the elevating member to push and discharge the contents toward the discharge port while being moved in a straight line together with the elevating member, wherein the coupling extension portion of the outer container is formed on an inner circumference thereof with a rotation limiting protrusion, and the inner container is formed on an outer circumference thereof with a rotation limiting groove, so that the rotation limiting protrusion and the rotation limiting groove are coupled to each other, thereby limiting the rotation of the inner container.

2. The rotational discharge-type cosmetic container of claim 1, wherein the outer container has one open side to which a shoulder is further coupled.

3. The rotational discharge-type cosmetic container of claim 1, further comprising:

a container cover for opening or closing the rotary member.

4. The rotational discharge-type cosmetic container of claim 1, wherein the coupling extension portion has a tube shape extending upward from a center of a bottom of the outer container.

5. The rotational discharge-type cosmetic container of claim 1, wherein the coupling extension portion of the outer container is formed on an outer circumference thereof with a straight guide protrusion, and the elevating member is formed on an inner circumference thereof with a straight guide groove, so that the straight guide protrusion and the straight guide groove are coupled to each other, thereby guiding the straight movement of the elevating member.

6. The rotational discharge-type cosmetic container of claim 1, wherein the coupling extension portion of the outer container is formed at a center thereof with an insertion hole into which at least a part of the inner container is inserted, and the insertion hole and the inner container are formed therein with a first locking protrusion and a second locking protrusion, respectively, so as to be locked and coupled to each other.

7. The rotational discharge-type cosmetic container of claim 1, wherein the rotary member has at least a part exposed from the outer container, and is rotatably coupled to the inner container while surrounding an upper part of the inner container.

8. The rotational discharge-type cosmetic container of claim 1, wherein the discharge port is formed on a top surface of the rotary member and includes a straight hole extending from a center to an edge part of the rotary member.

9. The rotational discharge-type cosmetic container of claim 1, wherein the rotary member is formed therein with a discharge guide protrusion adjacent to the discharge port, and the discharge guide protrusion protrudes inward from the rotary member.

10. The rotational discharge-type cosmetic container of claim 1, wherein the rotary operation member includes an inner wall extending upward from a bottom thereof, a first outer wall spaced apart from the inner wall by a predetermined distance and extending upward, and a second outer wall spaced apart from the first outer wall by a predetermined distance and extending upward.

11. The rotational discharge-type cosmetic container of claim 10, wherein the rotary member has an end inserted between the first outer wall and the second outer wall of the rotary operation member, and a plurality of first insertion protrusions and second insertion protrusions are formed on the rotary member and the first outer wall, respectively, so as to be inserted and coupled to each other.

12. The rotational discharge-type cosmetic container of claim 1, wherein the elevating member has a side wall divided into at least two parts, and the inner container is formed on a bottom surface thereof with a through-hole, in which the divided side wall passes through the through-hole so as to be inserted into an inner space of the inner container.

13. A rotational discharge-type cosmetic container comprising:

an outer container having a coupling extension portion formed therein;

an inner container fitted into the coupling extension portion of the outer container so as to be restricted in rotation to accommodate contents therein;

a rotary member rotatably coupled to an outer side of the inner container and having at least one discharge port formed therethrough;

a rotary operation member connected to the rotary member to be rotated together and having a first screw thread formed thereon;

an elevating member screw-coupled to the rotary operation member, inserted into the coupling extension portion of the outer container so as to be movable in a straight line, and having a second screw thread formed thereon; and a piston formed inside the inner container and coupled to one side of the elevating member to push and discharge the contents toward the discharge port while being moved in a straight line together with the elevating member, wherein the coupling extension portion of the outer container is formed at a center thereof with an insertion hole into which at least a part of the inner container is inserted, and the insertion hole and the inner container are formed therein with a first locking protrusion and a second locking protrusion, respectively, so as to be locked and coupled to each other.

14. A rotational discharge-type cosmetic container comprising:

an outer container having a coupling extension portion formed therein;

an inner container fitted into the coupling extension portion of the outer container so as to be restricted in rotation to accommodate contents therein;

a rotary member rotatably coupled to an outer side of the inner container and having at least one discharge port formed therethrough;

a rotary operation member connected to the rotary member to be rotated together and having a first screw thread formed thereon;

an elevating member screw-coupled to the rotary operation member, inserted into the coupling extension portion of the outer container so as to be movable in a straight line, and having a second screw thread formed thereon; and a piston formed inside the inner container and coupled to one side of the elevating member to push and discharge the contents toward the while being moved in a straight line together with the elevating member, wherein the rotary operation member includes an inner wall extending upward from a bottom thereof, a first outer wall spaced apart from the inner wall by a predetermined distance and extending upward, and a second outer wall spaced apart from the first outer wall by a predetermined distance and extending upward.

* * * * *